US007042169B2

(12) United States Patent
Neumeier et al.

(10) Patent No.: US 7,042,169 B2
(45) Date of Patent: May 9, 2006

(54) GAS DISCHARGE LAMP BASE COMPRISING AN IGNITION DEVICE

(75) Inventors: Klaus Neumeier, Tittling (DE); Anton Duschl, Hauzenberg (DE); Erwin Gaisbauer, Salzweg (DE); Johann Winkler, Hutthurn (DE); Roman Schichl, Passau (DE)

(73) Assignee: Vogt Electronic AG, (DE)

( * ) Notice: Subject to any disclaimer, the term of this patent is extended or adjusted under 35 U.S.C. 154(b) by 155 days.

(21) Appl. No.: 10/450,914

(22) PCT Filed: Dec. 19, 2001

(86) PCT No.: PCT/EP01/15036

§ 371 (c)(1),
(2), (4) Date: Nov. 12, 2003

(87) PCT Pub. No.: WO02/51214

PCT Pub. Date: Jun. 27, 2002

(65) Prior Publication Data

US 2004/0066150 A1 Apr. 8, 2004

(30) Foreign Application Priority Data

Dec. 19, 2000 (DE) ..... 100 63 232
Dec. 21, 2000 (DE) ..... 100 64 135

(51) Int. Cl.
*H05B 37/00* (2006.01)

(52) U.S. Cl. ..... 315/289; 315/276; 315/57; 315/70; 336/233; 336/221

(58) Field of Classification Search ..... 315/56–58, 315/61, 62, 70, 266, 274, 276, 281, 282, 315/209 CD, 209 M, 89; 336/172, 175, 336/182, 221, 222, 233
See application file for complete search history.

(56) References Cited

U.S. PATENT DOCUMENTS

| | | | | |
|---|---|---|---|---|
| 4,677,348 | A | 6/1987 | Schweickardt | |
| 5,185,560 | A | 2/1993 | Nilssen | |
| 5,228,770 | A | 7/1993 | Brunson | |
| 5,894,202 | A * | 4/1999 | Betz et al. | 315/289 |
| 6,057,611 | A * | 5/2000 | Reiser | 307/125 |
| 6,084,354 | A * | 7/2000 | Kohmura et al. | 315/57 |
| 6,194,834 | B1 * | 2/2001 | Seiler et al. | 315/82 |
| 6,731,076 | B1 * | 5/2004 | Gerhard et al. | 315/289 |
| 6,741,156 | B1 * | 5/2004 | Burkhardt et al. | 336/229 |

* cited by examiner

*Primary Examiner*—Haissa Philogene
(74) *Attorney, Agent, or Firm*—Rothwell, Figg, Ernest & Manbeck, PC

(57) ABSTRACT

A description is given of a gas-discharge lamp base (11) with a housing comprising an upper part (10) and a cover (40), a support (16) accommodated in the housing for receiving the components, with a transformer, with inductances connected in series with the lamp (1) and a capacitance connected in parallel with the lamp (1), the transformer comprising a bar transformer (23). This construction permits particularly efficient production, because the support can be constructed as a simple leadframe which permits automatic component fitting.

23 Claims, 8 Drawing Sheets

GAS DISCHARGE LAMP BASE COMPRISING AN IGNITION DEVICE

CROSS-REFERENCE TO RELATED APPLICATION

This application is a National Phase of International Application Serial No. PCT/EP01/15036, filed Dec. 19, 2001.

BACKGROUND OF THE INVENTION

1. Field of the Invention

The invention relates to a gas-discharge lamp base with igniting device of the type known from WO 00/59269 (D1).

2. Description of the Background Art

In the case of the known gas-discharge lamp base, the voltage supply and the igniting device for the lamp, and consequently a voltage of about 30 kV, have been successfully "accommodated" in a space of about 4×4×3 cm. However, the known lamp base is quite complicated in the way in which it is constructed and produced, since most of its components cannot be fitted automatically. Therefore, considerable manual work is necessary.

SUMMARY OF THE INVENTION

The invention is based on the object of providing a gas-discharge lamp base which is of a simpler construction and permits automatic component fitting.

U.S. Pat. No. 4,677,348 A1 (D2) already discloses a gas-discharge lamp base in which the transformer comprises a bar transformer. The publication does not disclose any details about how the gas-discharge lamp base is constructed.

In the case of the base according to the invention, the toroidal-core transformer 23 of D1 is replaced by a bar-core transformer. In the case of the latter, securely mounted connecting elements (winding ends) which allow automatic component fitting can be provided. The bar-core transformer is accommodated in an enclosed chamber formed in the housing.

The chamber is preferably formed on an outer wall of the upper part and a dividing wall provided in the upper part. The chamber is preferably provided with a recess for receiving the high voltage contact ("hot conductor") (120) of the bar-core transformer. The bar-core transformer is preferably cast in the chamber with casting compound.

A ferrite plate is preferably attached to one or both ends of the bar-core transformer (mushroom-core or H-core transformer). As a result, a lower secondary resistance is achieved with the same ignition voltage.

The bar-core transformer is preferably designed in such a way that the inductors 24 and 25 of D1 can be omitted. It is also possible to omit the capacitor 26 of D1, connected in parallel with the lamp, if the base is enclosed by a metal housing according to FIG. 16 of D1. Consequently, in the case of the base according to the invention, there is now only one element carrying high voltage, that is the bar-core transformer. Furthermore, in the case of the lamp base according to the invention, the support 16 of D1 is omitted. Its insulating function is taken over by a modified construction of the outer base part 10 and of the cover 40. The labyrinth on the cover and on the outer base part in this case takes over the insulating function of the support 16 of D1.

The metal bushings 71 (FIG. 15 of D1) for the connection wires 72, which serve as sealing elements and insertion aids, can be omitted entirely.

According to the invention, the function of the return conductor connection 63 (FIG. 12 of D1) is integrated in the leadframe 60 (FIG. 12 of D1), thereby resulting in a further reduction in the number of individual parts and making assembly easier. Furthermore, according to the invention, the capacitor 28 is designed as a foil capacitor suitable for automatic component fitting. In the case of the component 27 (FIG. 12 of D1), the special bending of the connection wire is omitted, the new geometry of the support 16 making more space available, so that here, too, component fitting can be performed with standard automatic machines.

According to the invention, the collar 39 for the connection plug (FIG. 13 of D1) is integrated into the outer base part 10 or the leadframe 60, whereby a full-area connection is achieved between the cover 40 and the outer base part 10 of D1. In this case, splash water protection of up to IP 67 (DIN 40050 "protection against electric shock and water") is possible. The function of the capacitor 29 can be moved out of the igniter into the electrical ballast. The arrangement of the components including the bar-core transformer on the support 16 of D1 allows automatic component fitting. In a further, particularly space-saving embodiment, the leadframe is formed in an angled manner (L- or U-shaped).

The aforementioned modifications now permit a three-part construction of the base. Fully automatic component fitting on the support for the electronics (alternatively leadframe or PCB (Printed Circuit Board)) can be carried out, as can the assembly of the three individual components. Further conceivable variants are leadframe construction in MID technology, outer base part in MID technology, whereby elimination of the leadframe is possible, partial or full encapsulation of the leadframe to achieve the function of the outer or upper part of the base.

Components in MID technology (Molded Interconnect Devices) are molded parts with an integrated conductor structure (3D). Apart from the integration of electronics and mechanics, they make it possible to save individual parts. MIDs can be produced by means of various production processes, which differ according to their metallization and structuring. A distinction is drawn essentially between two different technologies: 3D-MID technology and shielding technology.

BRIEF DESCRIPTION OF THE DRAWINGS

The invention is explained in more detail on the basis of the accompanying drawings, in which.

DETAILED DESCRIPTION OF THE INVENTION

Figure 1:
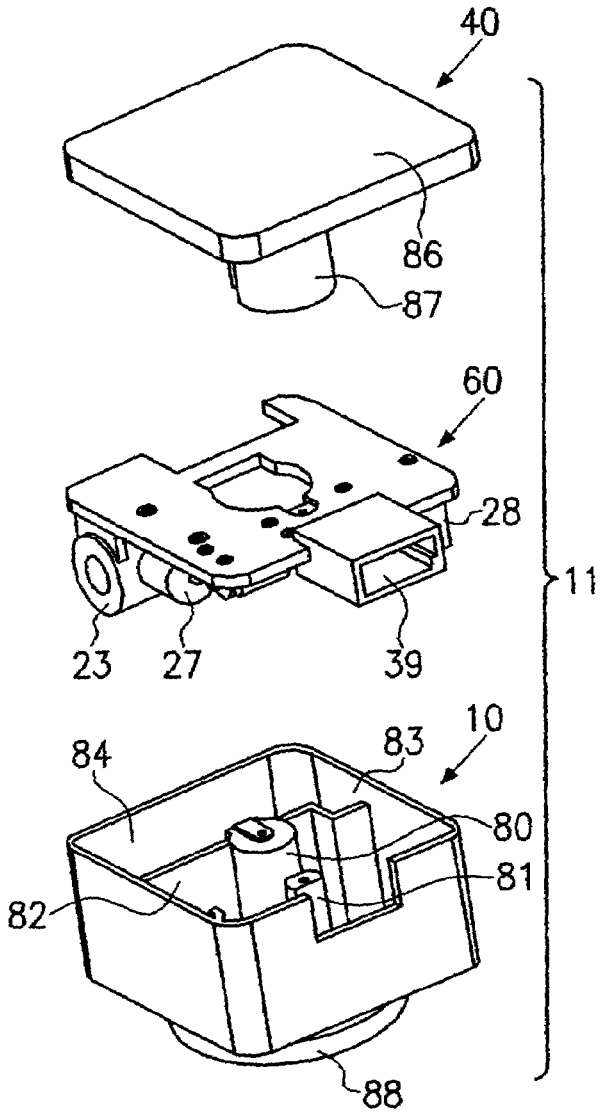
FIG. 1 shows an exploded perspective representation of the main component parts of a gas-discharge lamp base according to the invention.

FIG. 1 shows the three main component parts of the gas-discharge lamp base 11 according to the invention, with the upper housing part 10, the leadframe 60 and the lower housing part or cover 40. The upper housing parts 10 have a central stub 80 and a lateral stub 81 of a smaller diameter, through which the leads to the lamp (not shown here), to be placed on from below, are led. When this happens, the conductor in the central stub 80 is placed onto the upper face of the latter from the outside and subsequently cast. A dividing wall 82 in the upper housing part 10 forms a chamber 84, having a stepped indent or recess 83. In the case of the embodiment of FIG. 2, the collar 39 for receiving the plug is formed onto the housing of the upper part 10'. The leads are identifiable as upright red marks, in the same way as the foot contact on the stub 80.

In the case of the embodiment according to FIG. 1, the collar 39 is formed onto the leadframe 60. The leadframe 60 carries the bar-core transformer 23, the sparking gap 27, a foil capacitor 28 (FIG. 4) and a return conductor 85.

A lower housing part 40 substantially comprises a covering plate 86 and a cylindrical, hollow, downwardly open hollow cylinder or stub 87, which is formed onto the plate 86.

During assembly, the leadframe 60 is pushed together with its fitted components into the upper housing part 10, the bar-core transformer 23 being received in the chamber 84. In this case, the recess 83 serves for receiving the connections of the bar-core transformer 23. The bar-core transformer 23 is subsequently cast, only little casting compound being required as a result of the dividing wall 82, much less than in the case of the known lamp base according to D1. The conductor ends of the lamp led up through the stubs 80, 81 are welded or soldered to the printed circuit board. To be specific, the stub 80 (Hv contact of the lamp) is connected via the injection-molded-in central contact to the hot end of the transformer. The stub 81 (Lv contact of the lamp) is connected to the printed circuit board or the leadframe 60.

The lower housing part 40 is subsequently inserted with its stub 87 into the upper housing part 10, the stub 87 enclosing the stub 80 and so forming the labyrinth necessary for the avoidance of flashovers. The lower surface of the covering plate 86 lies on the upper surface of the leadframe 60.

Figure 4:
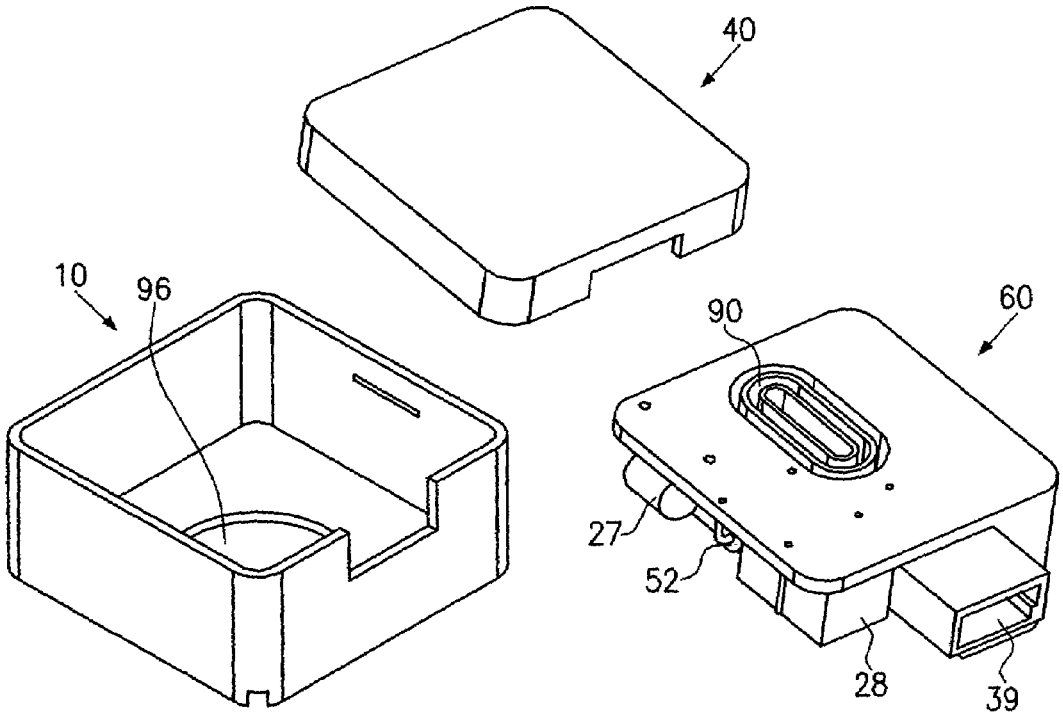
FIG. 4 shows the exploded perspective representation of a third embodiment of a lamp base.

FIG. 4 shows the exploded perspective representation of a third embodiment of the lamp base. The leadframe 60 is provided on its upper side with a number of encircling lamellae 90, with a bore for the leading through of the "hot conductor" of the lamp being located in the inner oval. The upper housing part 40 bears corresponding lamellae (which cannot be seen in the representation of FIG. 4), which reach into the grooves formed between the lamellae 90 on the leadframe.

Figure 5:
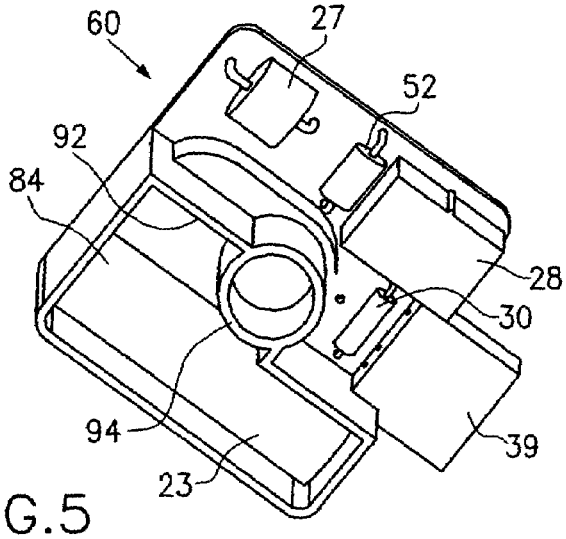
FIG. 5 shows the perspective view of the leadframe of FIG. 4.

Arranged on the underside of the leadframe 60, shown in FIG. 5, are the already mentioned components of the circuit. A lamella 2, which follows the outer contour of the leadframe 60, encloses the bar-core transformer 23 and is led to a central circular-cylindrical eye 94, encloses the bar-core transformer 23 and in this way forms a chamber 84, which is filled with casting compound. It is also the case in this embodiment that only little casting compound is required.

The upper housing part 10 is provided on its lower face in FIG. 4 with a circular opening 96. During assembly, the leadframe 60 is inserted into the upper housing part 10. The lamp (not shown) is placed onto it through the opening 96 and the circular-cylindrical lamella 94, in such a way that the "hot conductor" protrudes through the bore provided for it in the printed circuit board 60 into the central oval between the lamellae 90. Here it is welded to a connection located there. Subsequently, the lower housing part 40 is placed onto the leadframe 60, so that the lamellae 90 of the leadframe 60 and those of the lower housing part 40 engage in one another and form the labyrinth.

Figure 2:
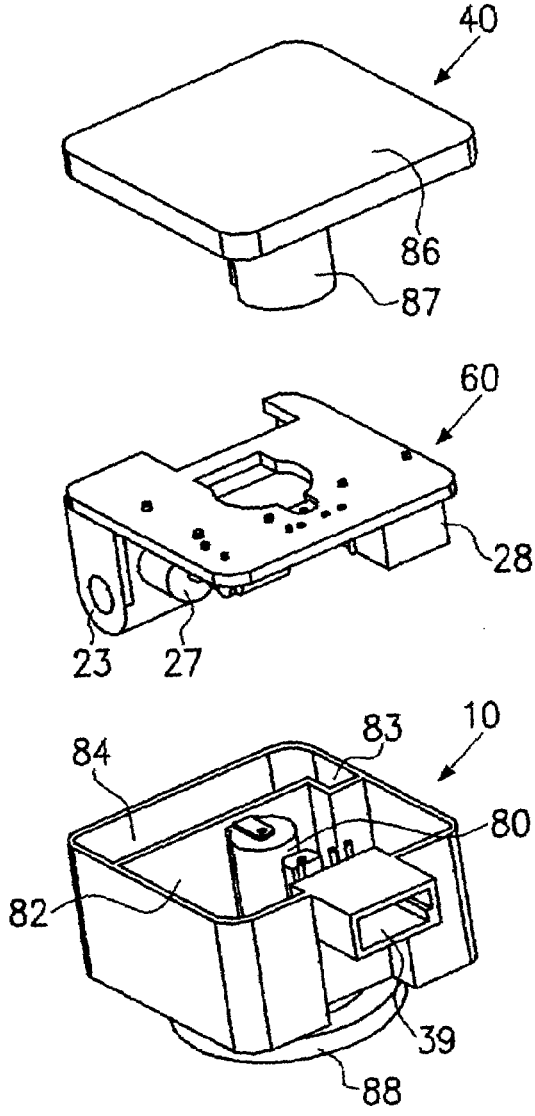
FIG. 2 shows the exploded perspective representation of a slightly modified embodiment of a lamp base.
Figure 3:
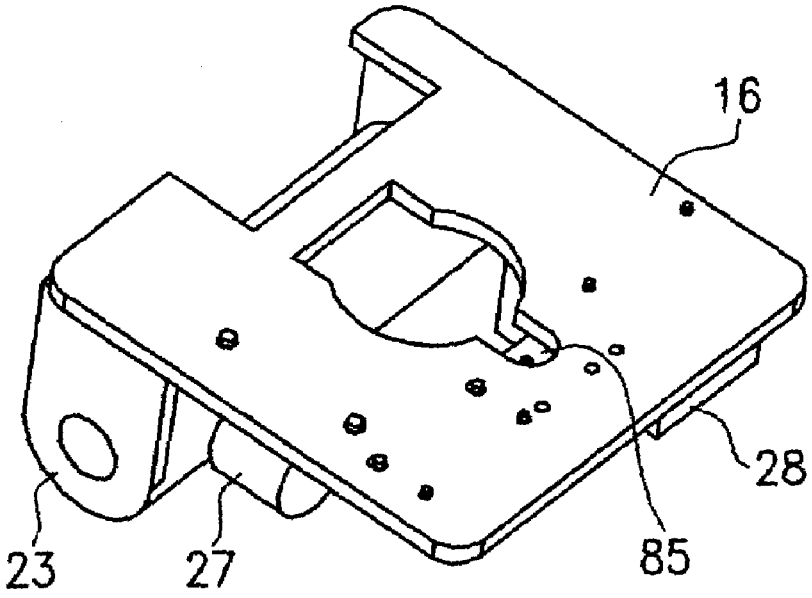
FIG. 3 shows the upper housing part and the leadframe of FIG. 2 from a changed viewing angle.
Figure 3:
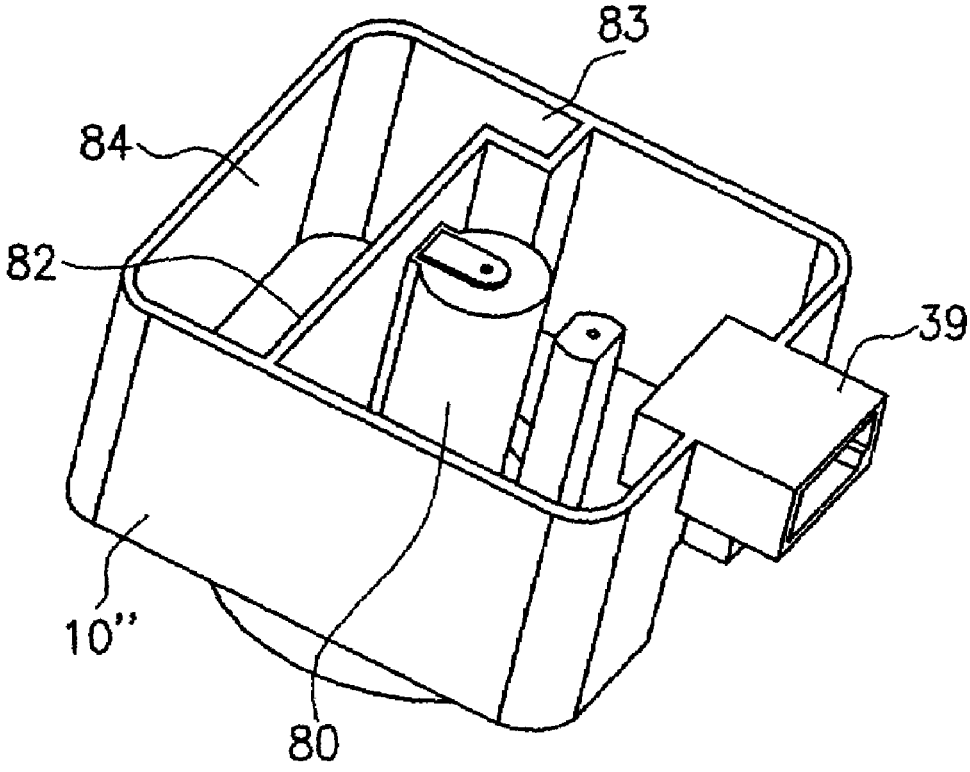

In contrast with the embodiments of FIGS. 1, 2 and 3, in which the welded collar 88 for the lamp is formed onto the upper housing part 10, in the case of the embodiment of FIGS. 4 and 5 the lamp must be provided with the welded collar.

The embodiment of FIGS. 4, 5 has the advantage over those of FIGS. 1, 2, 3 that, for the most part, the same, that is existing, tools can be used as in the case of D1. At the same time, no adaptations to the production line are required at the customer's premises, that is to say where the base and lamp are assembled.

Figure 6:
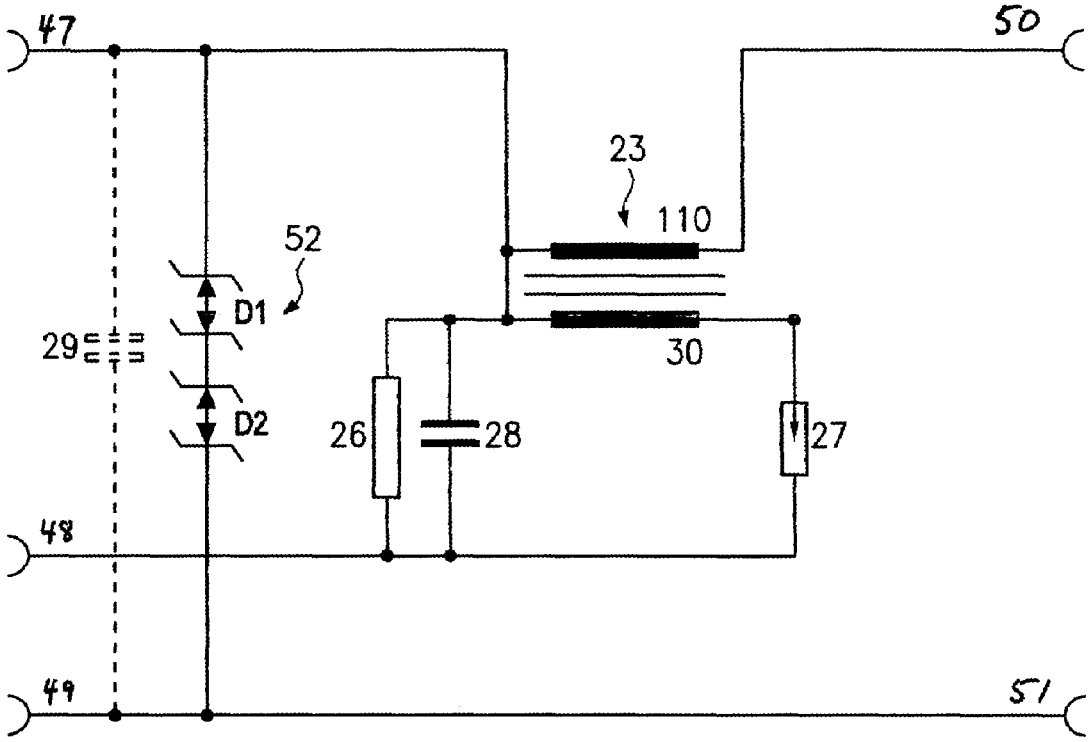
FIG. 6 shows the circuit diagram of a lamp base according to the invention.

FIG. 6 shows the circuit diagram of the igniting device and of the power supply of the ballast. As a comparison with FIGS. 11 and 17 of D1 shows, the circuit has being considerably "slimmed down". The igniting device is a so-called asymmetric pulse igniting device. Of three DC voltage connections 47, 48, 49, two are used according to choice. The DC voltage connection 49 is connected to ground and is looped through to the lamp connection 51. Between the connections 47 and 49 there lies one or two so-called TRANSIL® diodes 52, which serve as threshold switches. The connection 47 is led to a respective terminal of the primary winding 30 and of the secondary winding 110 of the bar-core transformer 23. Between these terminals and the connection 48 there lie a foil capacitor 28 and a discharging resistor 26. The second connection of the primary winding N1 is led via a sparking gap 27 to the connection 48. The second terminal of the secondary winding 110 of the bar-core transformer 23 is led to the lamp connection 50. The discharging resistor 26 may be welded before assembly to the capacitor 28 or to the sparking gap 27, according to choice, in automatic production, so that the component fitting and laser welding of the resistor 26 to the lead frame or the printed circuit board can be omitted.

Figure 7:
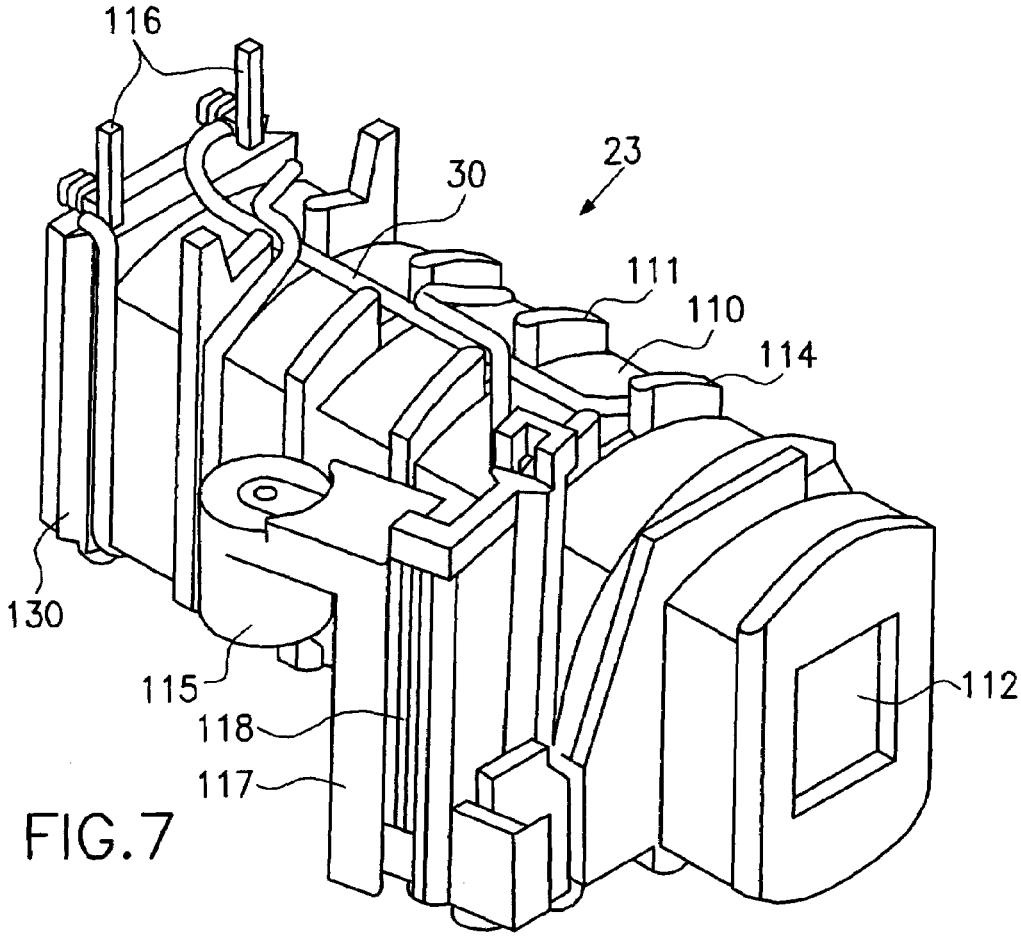
FIG. 7 shows the perspective view of an at this stage only partly wound bar-core transformer with the receptacle for the cental contact of the lamp formed as a separate component.

FIG. 7 shows a perspective representation of a bar-core transformer 23, on the coil former of which a primary winding 30 is wound, to be precise respectively in portions between lamellae 111 formed on the coil former. The end face 112 of the bar core, which is enclosed by the coil former and the secondary winding 110, can be seen. The lamellae 111 are provided on the upper side (and correspondingly on the underside) with grooves 114, into which the primary winding 30 is laid. Arranged at the rear end of the bar-core transformer 23 are the contacts 116 for the primary winding 30. One contact is connected to the beginning of the primary coil 30 and the beginning of the secondary coil 110, the other is connected to the end of the primary winding 30. The primary winding 30 is configured in a multiply bandaged construction or with a multiply extruded construction in order to achieve a high dielectric strength.

Figure 8:
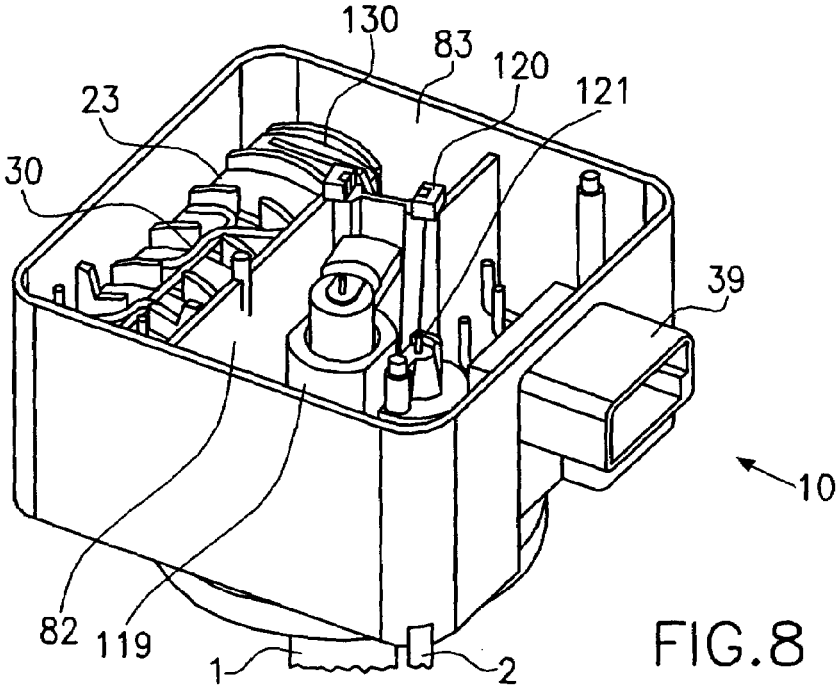
FIG. 8 shows the upper housing part with the bar-core transformer inserted.

Connected to the coil former is a receptacle 115 for the "hot conductor" of the lamp. The molded part forming the receptacle 115 is provided with a wall 117, on the outer edges of which grooves are provided. With the aid of these grooves 118, the receptacle 115 is inserted into a corresponding relief of the dividing wall 82 (FIG. 8). In this way, a labyrinth is formed to extend the length of the leakage path.

At the end of the bar-core transformer, a thickening can be seen. This is in this case a ferrite plate 130 attached to the end of the actual bar core. The ferrite plate allows a lower secondary resistance to be achieved with the same ignition voltage.

FIG. 8 shows the upper housing part 10 with the inserted bar-core transformer 23, the base 119 of the lamp 1. Above the base 119, the "hot conductor" 120 of the lamp 1 can be seen, to the right of it the return conductor 121 of the return 2 of the lamp 1 can be seen. In practice, the leadframe 60 is firstly fitted with all the components and then inserted into the upper housing part 10. The state shown in FIG. 8 therefore never occurs in practice.

Figure 9:
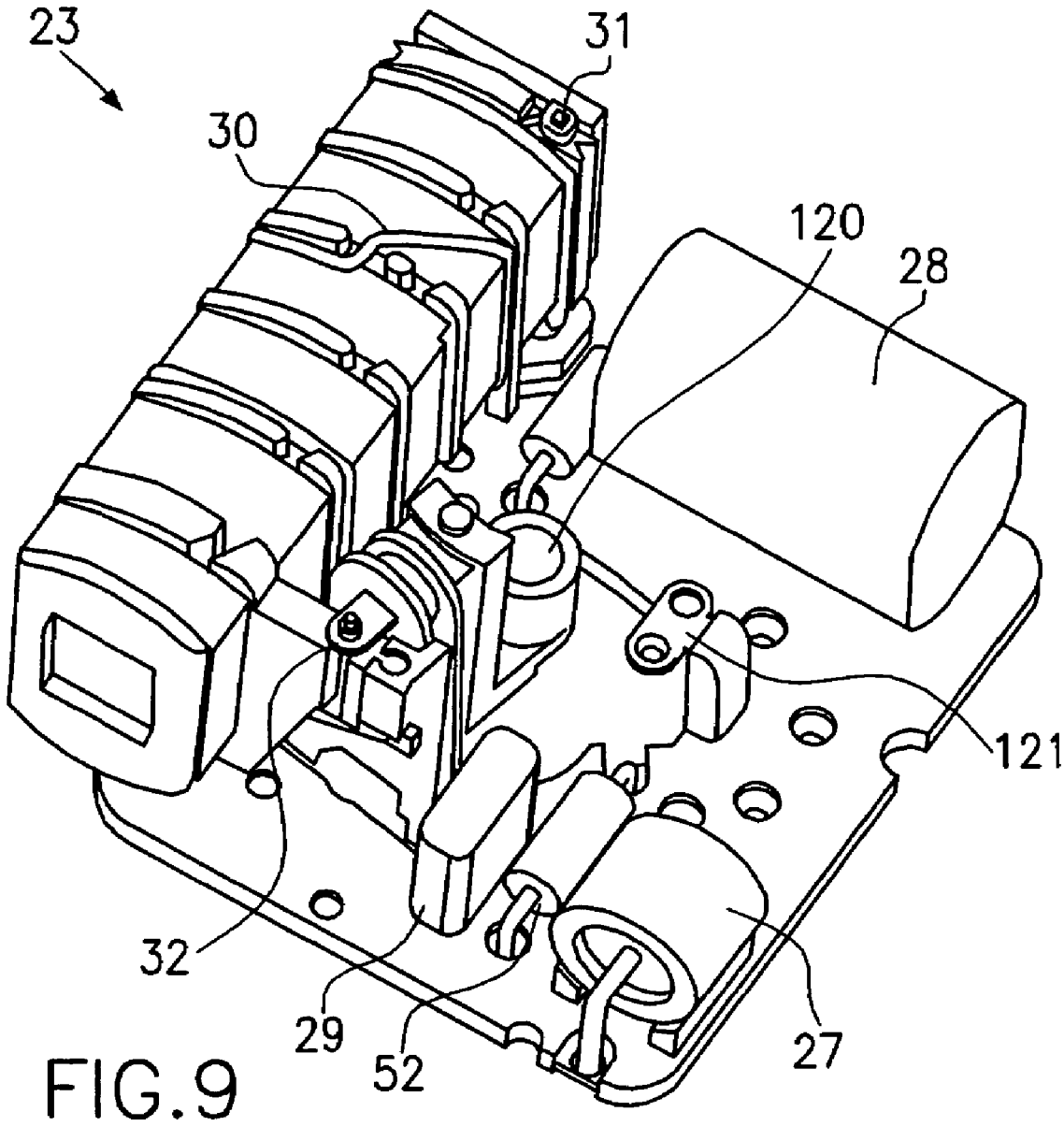
FIG. 9 shows a perspective plan view of the leadframe with the components fitted.

FIG. 9 shows the plan view of the leadframe 60 fitted with the components. To be specific, the following can be seen: the sparking gap 27, the foil capacitor 28, the optional input capacitor 29, the bar-core transformer 23 with the primary winding 30 and the two ends 31 and 32, which are connected to the beginning of the primary winding 30 and the beginning of the secondary winding 110 or the (hot) end of the secondary winding. Attention should also be drawn to the ends of the hot conductor 120 and of the return conductor 121.

Figure 10:
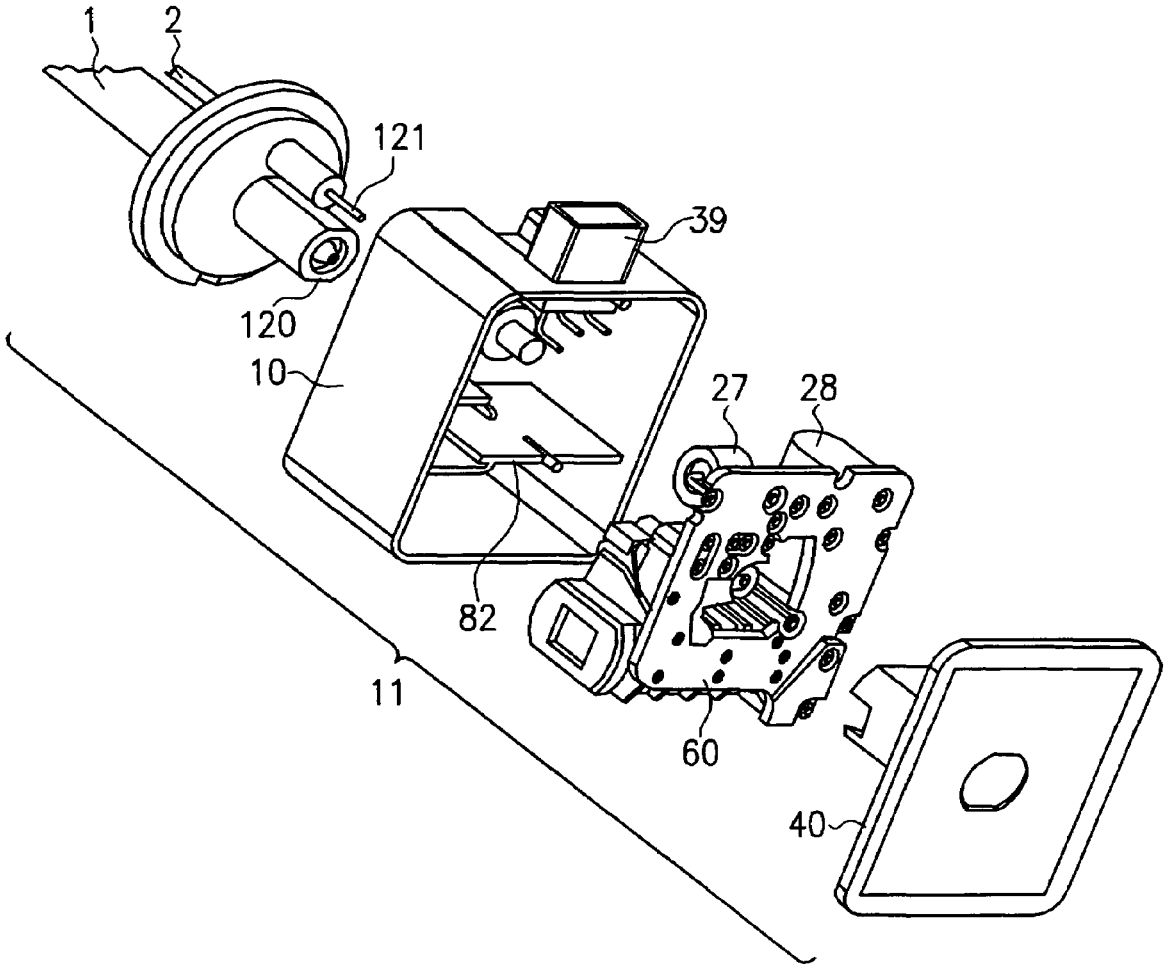
FIG. 10 shows an exploded perspective representation of the main component parts of one embodiment of the gas-discharge lamp base according to the invention with the bar-core transformer of FIGS. 7 and 8.

FIG. 10 shows an exploded representation of the component parts of the gas-discharge lamp base 1 with the upper housing part 10, the leadframe 60 fitted with components and the cover 40. FIG. 10 also shows the lamp 1 to be inserted into the base after the assembly of the latter.

Figure 11:
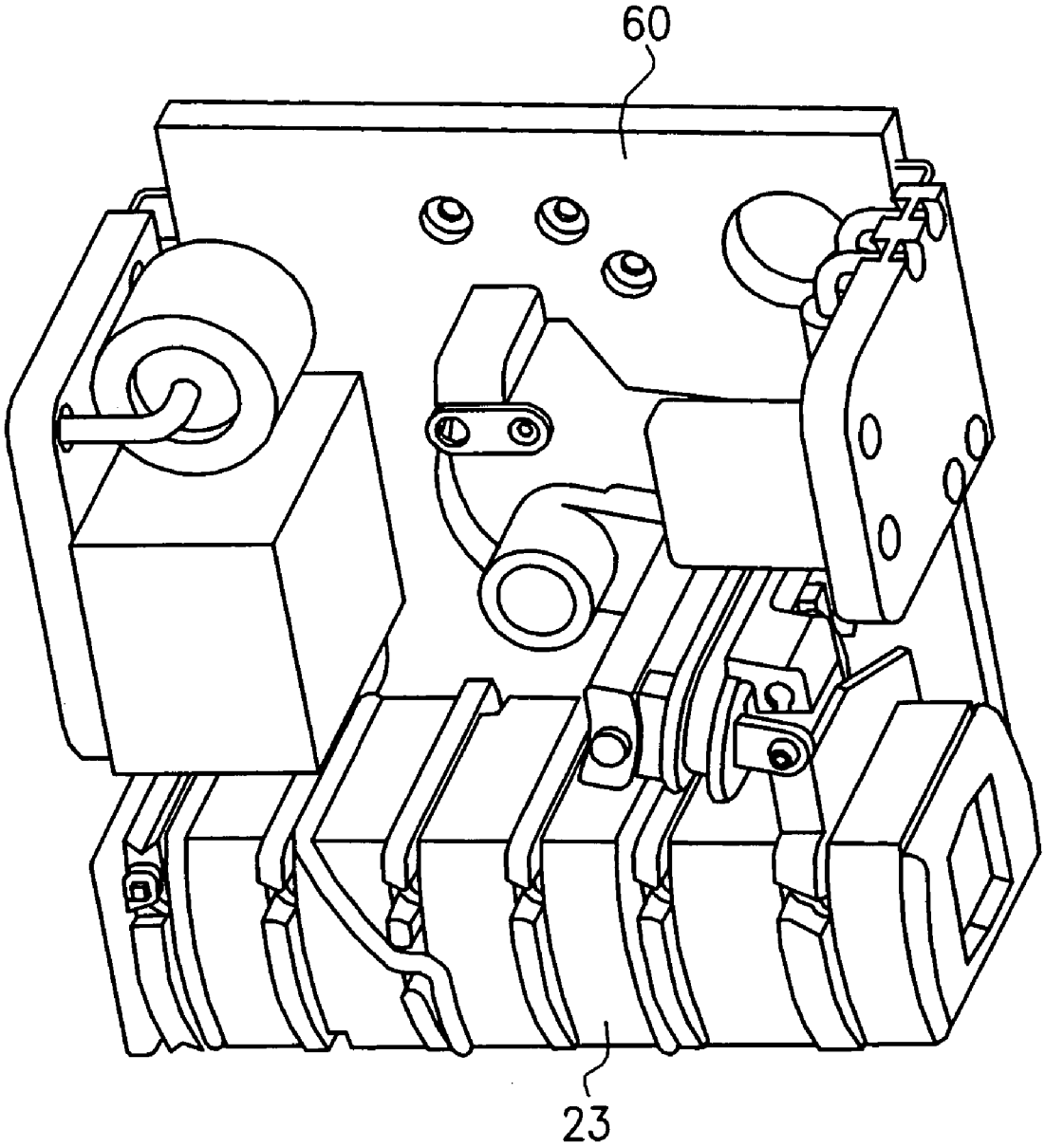
FIG. 11 shows an angled leadframe fitted with the components.

FIG. 11 finally shows a U-shaped printed circuit board 60 fitted with the components, which may be configured by the leadframe technique or as a printed board.

The invention claimed is:

1. A gas-discharge lamp base with a housing comprising an upper part and a cover, a support accommodated in the housing for receiving components, with a transformer, with inductances connected in series with a lamp and a capacitor connected in parallel with the lamp, wherein the transformer comprises a bar-core transformer and is accommodated in a separated chamber formed in the upper part.

2. The gas-discharge lamp base as claimed in claim 1, wherein the chamber is formed by an outer wall of the upper part and a dividing wall provided in the upper part.

3. The gas-discharge lamp base as claimed in claim 2, wherein the chamber is provided with a recess for receiving a high-voltage contact ("hot conductor") of the bar-core transformer.

4. The gas-discharge lamp base as claimed in claim 1, wherein the bar-core transformer is cast in the chamber with casting compound.

5. The gas-discharge lamp base as claimed in claim 1, wherein a ferrite plate is attached to one or both ends of the bar-core transformer.

6. The gas-discharge lamp base as claimed in claim 1, wherein the bar transformer is designed in such a way that inductors forming inductances as discrete components are omitted.

7. The gas-discharge lamp base as claimed in claim 1, wherein the base is enclosed by a metal housing.

8. The gas-discharge lamp base as claimed in claim 1, wherein the support is formed as a leadframe.

9. The gas-discharge lamp base as claimed in claim 8, wherein a return line from the lamp is integrated in the leadframe.

10. The gas-discharge lamp base as claimed in claim 1, wherein the capacitor of an oscillating ignition circuit is formed as a foil capacitor.

11. The gas-discharge lamp base as claimed in claim 8, wherein a collar for the connection plug is integrated in the leadframe or the upper housing part.

12. The gas-discharge lamp base as claimed in claim 8, wherein the leadframe is formed in an angled manner (L- or U-shaped).

13. A gas-discharge lamp base with a housing comprising an upper part and a cover, a support accommodated in the housing for receiving components, with a transformer, with inductances connected in series with a lamp and a capacitor connected in parallel with the lamp, wherein the transformer comprises a bar-core transformer and is accommodated in a separated chamber formed in the upper part and, wherein a ferrite plate is attached to one or both ends of the bar-core transformer.

14. The gas-discharge lamp base as claimed in claim 13, wherein the chamber is formed by an outer wall of the upper part and a dividing wall provided in the upper part.

15. The gas-discharge lamp base as claimed in claim 14, wherein the chamber is provided with a recess for receiving a high-voltage contact ("hot conductor") of the bar-core transformer.

16. The gas-discharge lamp base as claimed in claim 13, wherein the bar-core transformer is cast in the chamber with casting compound.

17. The gas-discharge lamp base as claimed in claim 13, wherein the bar transformer is designed in such a way that inductors forming inductances as discrete components are omitted.

18. The gas-discharge lamp base as claimed in claim 13, wherein the base is enclosed by a metal housing.

19. The gas-discharge lamp base as claimed in claim 13, wherein the support is formed as a leadframe.

20. The gas-discharge lamp base as claimed in claim 19, wherein a return line from the lamp is integrated in the leadframe.

21. The gas-discharge lamp base as claimed in claim 13, wherein the capacitor of an oscillating ignition circuit is formed as a foil capacitor.

22. The gas-discharge lamp base as claimed in claim 19, wherein a collar for the connection plug is integrated in the leadframe or the upper housing part.

23. The gas-discharge lamp base as claimed in claim 19, wherein the leadframe is formed in an angled manner (L- or U-shaped).

* * * * *